US006319037B1

(12) United States Patent
Lai

(10) Patent No.: US 6,319,037 B1
(45) Date of Patent: Nov. 20, 2001

(54) RETENTION CLIP FOR CARD EDGE CONNECTOR

(75) Inventor: Ming Chun Lai, Shin-Jung (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/746,529

(22) Filed: Dec. 21, 2000

(30) Foreign Application Priority Data

Sep. 29, 2000 (TW) ..... 89216959 U

(51) Int. Cl.[7] ..... H01R 13/62
(52) U.S. Cl. ..... 439/327; 361/801; 361/807
(58) Field of Search ..... 439/327, 325, 439/366; 361/801, 802, 807, 809; 206/706; 24/563

(56) References Cited

U.S. PATENT DOCUMENTS 5,423,691 * 6/1995 Pickles ..... 439/327
5,483,422 * 1/1996 Bowen et al. ..... 361/802
5,943,218 * 8/1999 Liu ..... 361/801
6,007,357 * 12/1999 Perino et al. ..... 439/327
6,056,579 * 5/2000 Richards, III et al. ..... 439/358
6,176,727 * 1/2001 Liu et al. ..... 439/358
6,236,573 * 5/2001 Gundlach et al. ..... 361/801

* cited by examiner

*Primary Examiner*—Brian Sircus
*Assistant Examiner*—Thanh-Tam Le
(74) *Attorney, Agent, or Firm*—Wei Te Chung

(57) ABSTRACT

A retention clip (30) comprises a pair of substantially vertical spring arms (32) and a horizontal bridge (33) connecting the spring arms. Each spring arm has a free end for detachably engaging with a corresponding longitudinal end of an insulative housing (24) of a card edge connector (20). The bridge defines a groove (39) therein for receiving a top edge portion of a card (4) inserted into the card edge connector. The retention clip further comprises a pair of spring tongues (34) downwardly projecting beyond a lower surface (35) of the bridge for resiliently retaining the inserted card in a vertical direction.

16 Claims, 4 Drawing Sheets

RETENTION CLIP FOR CARD EDGE CONNECTOR

BACKGROUND OF THE INVENTION

1. Field of the Invention

The present invention relates to a retention means for a card edge connector, and particularly to a retention clip for a card edge connector for releasably retaining a card in a central slot of the card edge connector.

2. Description of Prior Art

A retention means is commonly used for retaining an inserted card in a central slot of a card edge connector, thereby interconnecting the inserted card with a PCB (Printed Circuit Board) on which the card edge connector is mounted. Conventional retention means typically takes the form of a pair of rotatable latches disposed on opposite longitudinal ends of an insulative housing of the card edge connector. FIG. 4 shows a card edge connector 5 having a pair of conventional rotatable latches 52 disposed on opposite longitudinal ends thereof. An elongated central slot 53 is defined in an insulative housing 51 of the connector 5 for receiving a card 6 therein. When each latch 52 moves to its vertical fixed position, a locking peg 521 formed thereon engages with a corresponding notch 61 in the inserted card 6, thereby retaining the card 6 in the central slot 53 of the connector 5.

However, if the inserted card 6 has a high profile or the connector 5 is mounted on a PCB which stands vertically in a computer case and then the card 6, which is inserted into the connector 5, is in a horizontal state in the computer case, the latches 52 may not reliably retain the card 6 in position, especially when the computer case is subject to significant vibration. As a result, the inserted card 6 may tilt toward one side wall of the insulative housing 51, whereby a reliable connection between the terminals received in another side wall of the insulative housing 51 and corresponding gold fingers (not shown) printed on a bottom edge portion of the card 6 may not be obtained In addition, special structures must be provided on the latch 52 and the insulative housing 51 to achieve a rotatable engagement therebetween, thereby complicating manufacturing and increasing production cost. Further, since the card 6 is retained in the central slot 53 of the connector 5 via engagement between the notch 61 and the locking peg 521 of the latch 52, an accurate alignment between the notch 61 and the locking peg 521 is required, which also complicates manufacturing.

Hence, an improved card retention means for a card edge connector is desired to overcome the above-mentioned deficiencies.

SUMMARY OF THE INVENTION

Accordingly, one object of the present invention is to provide a retention clip for a card edge connector which is easy to manufacture, thereby significantly reducing production cost.

Another object of the present invention is to provide a retention clip for a card edge connector which can securely retain an inserted card in the card edge connector in all directions.

A further object of the present invention is to provide a retention clip for a card edge connector which has a simple structure and which is easy to assemble and disassemble.

In order to achieve the objects set forth, a retention clip in accordance with the present invention comprises a pair of substantially vertical spring arms and a horizontal bridge connecting the spring arms. Each spring arm forms a retention section at a free end thereof for engaging with a corresponding engaging section formed on each opposite longitudinal end of an insulative housing of a card edge connector. Each retention section includes a pair of longitudinally extending wings for engaging with a corresponding peg downwardly extending from an upper ledge of the insulative housing of the card edge connector, and a pair of flanges laterally and outwardly extending from respective free ends of the wings for engaging with corresponding recesses each defined at the junction between the corresponding peg and the body of the insulative housing of the card edge connector. The bridge forms a pair of opposite large-dimensioned end sections each with a groove defined therein for receiving a top edge portion of a card inserted into a central slot of the insulative housing of the card edge connector, whereby lateral movements of the inserted card relative to the insulative housing of the card edge connector is prevented.

The retention clip further comprises a pair of spring tongues downwardly projecting beyond a lower surface of the bridge for retaining the card in position in a vertical direction. Each spring tongue may be formed by downwardly bending a horizontal free end of the spring arm which extends through the bridge. Alternatively, the spring tongues may be formed by integrally stamping them from the bridge.

Other objects, advantages and novel features of the invention will become more apparent from the following detailed description when taken in conjunction with the accompanying drawings.

DETAILED DESCRIPTION OF THE INVENTION

Figure 1:
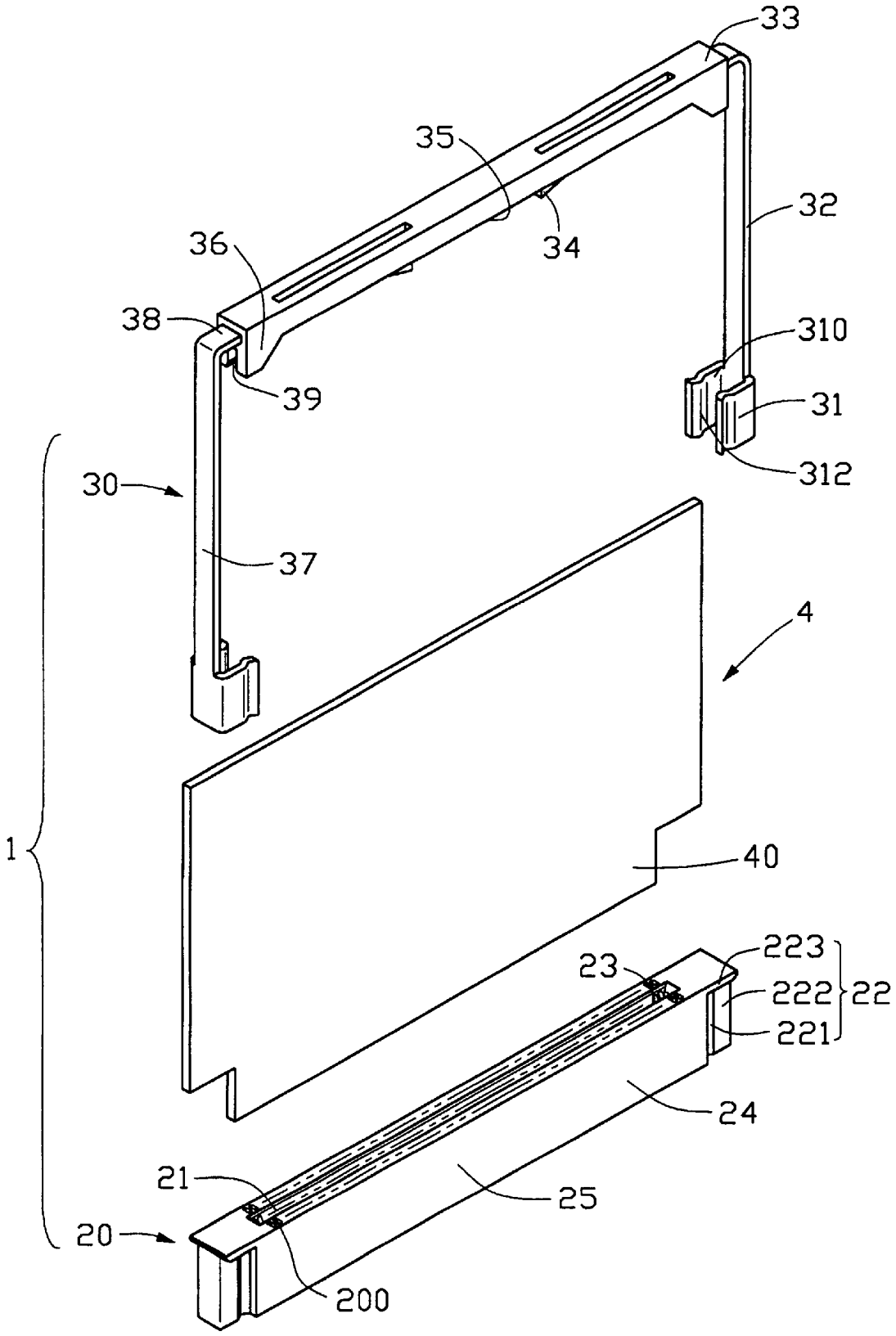
FIG. 1 is an exploded view of a card edge connector assembly including a card edge connector, a retention clip of the present invention, and a card to be inserted into the card edge connector.

Reference will now be made to the drawing figures to describe the present invention in detail.

Referring to FIG. 1, a card edge connector assembly 1 comprises a card edge connector 20, a card 4 adapted to be inserted into the card edge connector 20, and a retention clip 30 of the present invention for retaining the inserted card 4 in the card edge connector 20.

The card edge connector 20 comprises an insulative housing 24 and a plurality of terminals 23 received in the insulative housing 24. An elongated central slot 21 is defined in the insulative housing 24 for receiving a narrow, bottom edge portion 40 of the card 4. Two rows of passageways 200 are respectively defined in opposite side walls 25 of the insulative housing 24 for receiving the terminals 23 therein. An engaging section 22, which is formed on each longitudinal end of the insulative housing 24 for engaging with the retention clip 30, includes an upper ledge 223, a peg 222 downwardly extending from the ledge 223 and a pair of opposite vertical recesses 221 defined at the junction of the peg 222 and the body (not labeled) of the insulative housing 24.

The retention clip 30 comprises a pair of opposite spring arms 32 and a bridge 33 connecting the two spring arms 32. Each spring arm 32 comprises a vertical first end portion 37 and a substantially horizontal second end portion 38. Each first end portion 37 forms a retention section 31 at the free end thereof for engaging with a corresponding engaging section 22 of the insulative housing 24. The retention section 31 includes a pair of wings 310 extending in a longitudinal direction relative to the associated housing 24 of the card edge connector 20, and a pair of flanges 312 laterally and outwardly extending from a free end of each of the respective wings 310. Each second end portion 38 is partially retained in the bridge 33 and then downwardly bends to form a spring tongue 34 at a free end thereof projecting beyond a lower surface 35 of the bridge 33. The bridge 33 provides a pair of opposed large-dimensioned end sections 36 each with a groove 39 defined therein for engaging with a top edge portion of the card 4. The bridge 33 may be made of a plastic or a metal material.

Figure 2:
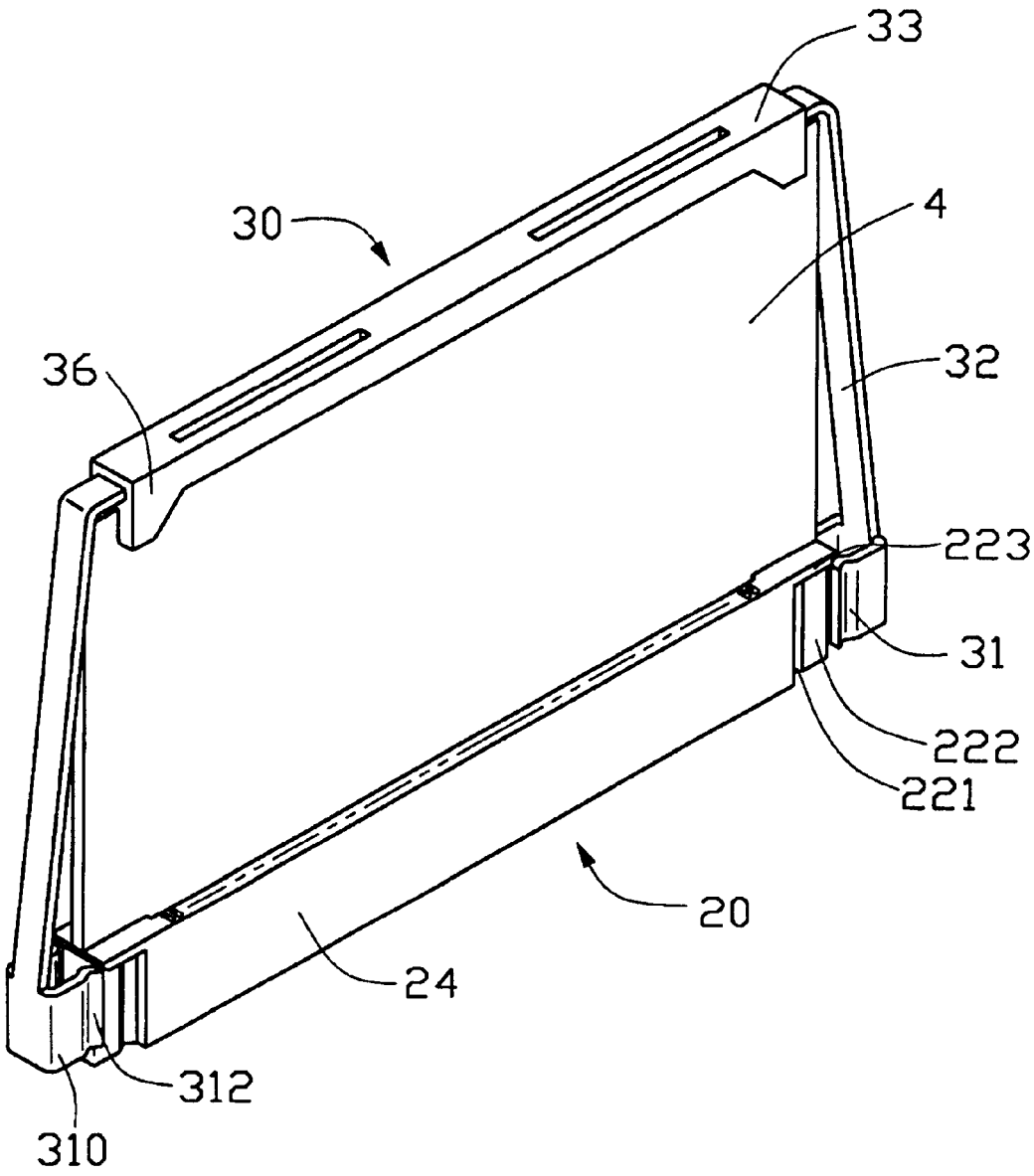
FIG. 2 is a partially assembled view of FIG. 1 with the retention clip being ready to be completely engaged with the card edge connector.
Figure 3:
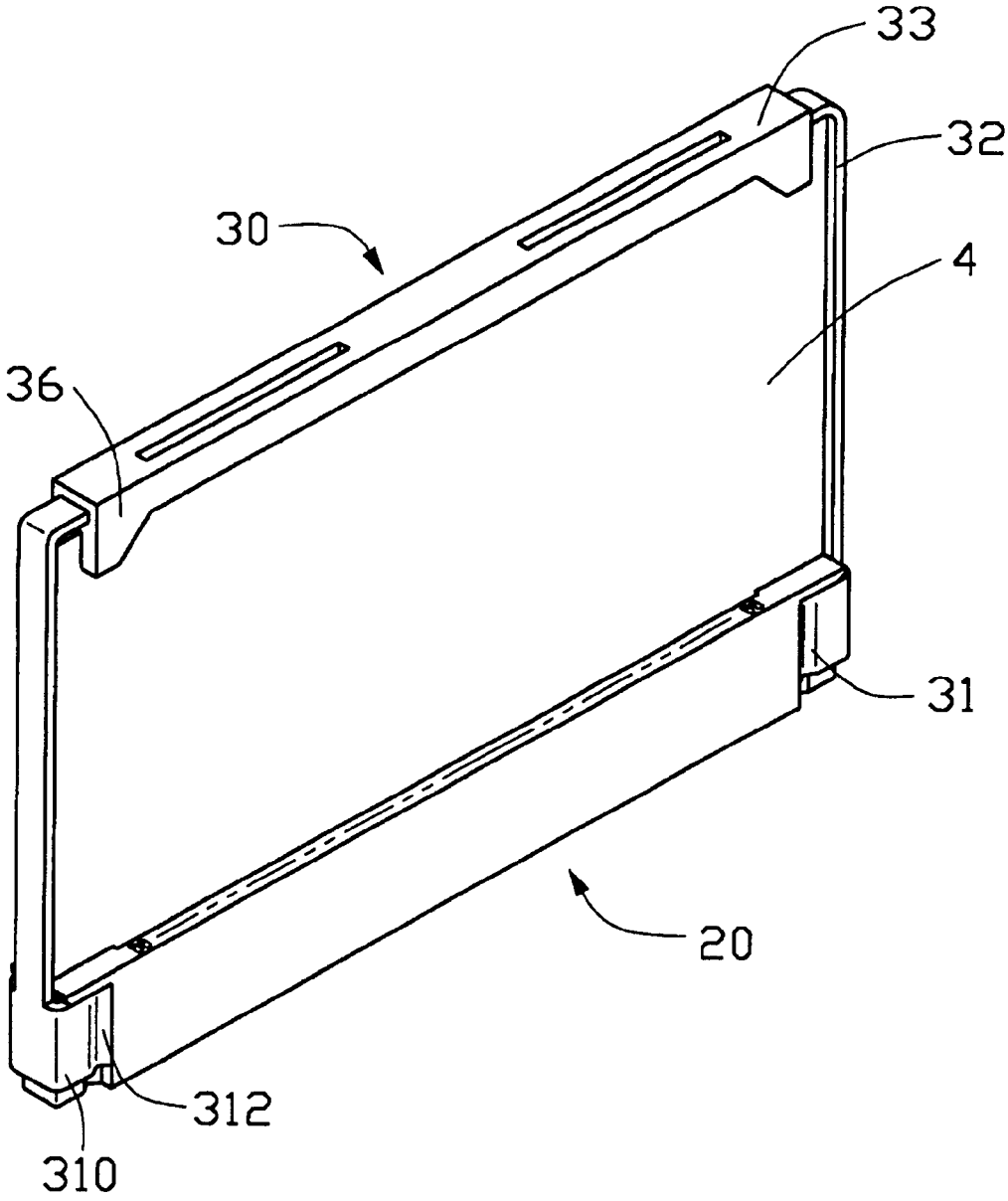
FIG. 3 is an assembled view of FIG. 1 with the retention clip being completely engaged with the card edge connector.
Figure 4:
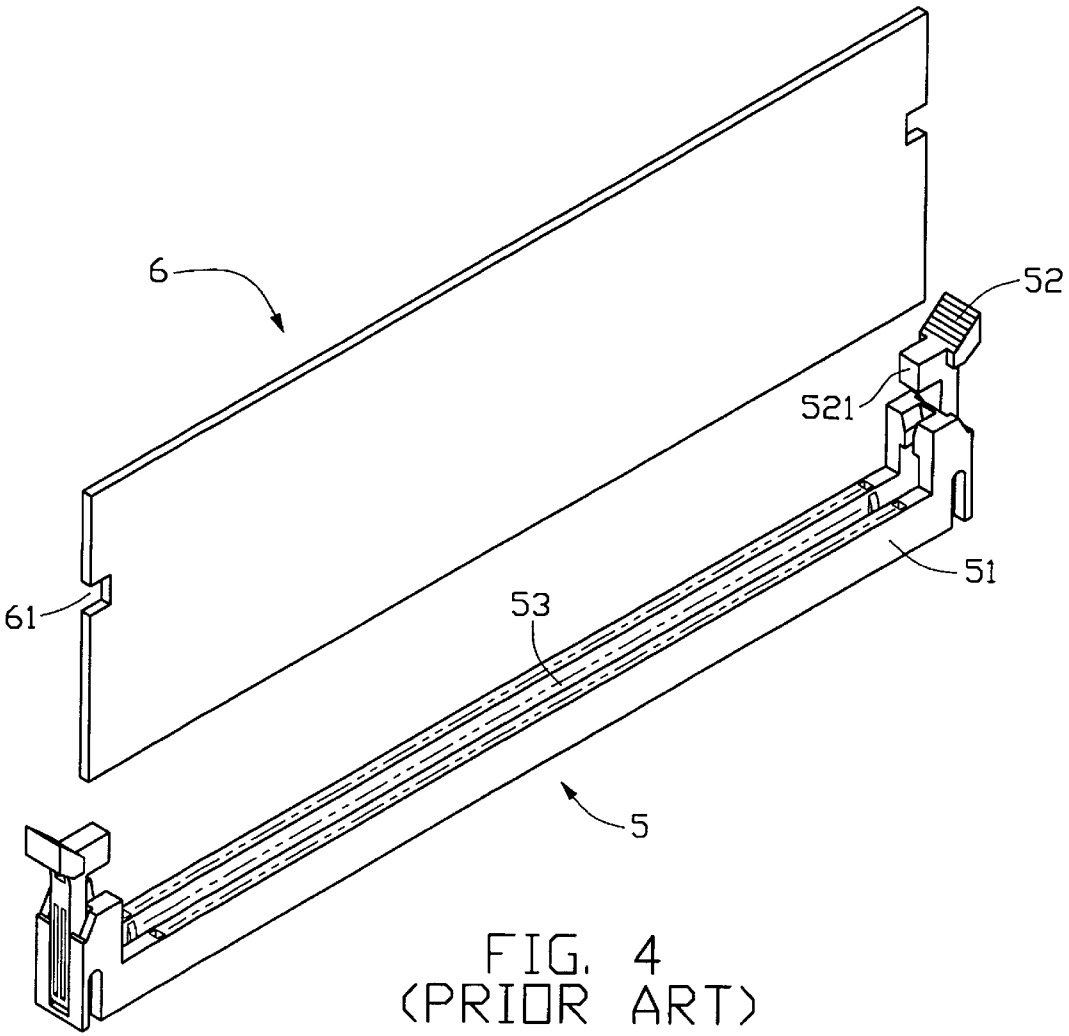
FIG. 4 (PRIOR ART)
FIG. 4 is a perspective view showing a card edge connector having a pair of conventional rotatable latches, and a card to be inserted into the card edge connector.

As is illustrated in FIGS. 2 and 3, in assembly, the narrow, bottom edge portion 40 of the card 4 is first inserted into the central slot 21 of the insulative housing 24. The retention clip 30 is then assembled to the inserted card 4 and the insulative housing 24 from the top for retaining the inserted card 4 in position. The spring arms 32 are pulled away from each other and the grooves 39 engage upper corners of the card 4. The flanges 312 of the retention sections 31 first engage with corresponding pegs 222 of the engaging sections 22 of the insulative housing 24. The retention sections 31 of the spring arms 32 are then pushed inward to engage the flanges 312 thereof with the recesses 221 and to engage the wings 310 thereof with the pegs 222, while the top edges of the wings 310 abut against the upper ledges 223 to prevent an upward movement of the retention clip 30. Thus, the retention clip 30 is mounted to the insulative housing 24. In the assembly process, the grooves 39 of large-dimensioned end sections 36 of the bridge 33 simultaneously receive the top edge portion of the inserted card 4, and the spring tongues 34 press the top edge of the card 4. The grooves 39 and the spring tongues 34 of the retention clip 30 respectively prevent lateral and vertical movements of the inserted card 4, and the spring arms 32 sandwich the card 4 therebetween to prevent the longitudinal movement of the inserted card 4. Thus, the inserted card 4 is securely retained in position by the retention clip 30.

By the design of the retention clip 30 of the present invention, even if the inserted card 4 has a high profile or is in a horizontal state in a computer case, or even if the card edge connector 20 is subject to great vibration, the inserted card 4 can be more retentively retained in the central slot 21 of the card edge connector 20 by the retention clip 30 compared with the conventional latches. Furthermore, the downwardly extending spring tongues 34 of the retention clip 30 can compensate for manufacturing tolerance of the card 4, and thus the engagement between the retention clip 30 and the card 4 can be easily achieved without highly precise alignment therebetween. The simple structure of the retention clip 30 also facilitates manufacturing and reduces production cost. In addition, since the retention clip 30 and the insulative housing 24 of the card edge connector 20 are assembled together by the latchable engagement between the retention sections 31 and the engaging sections 22, the assembly and disassembly of the retention clip 30 to and from the card edge connector 20 are also significantly facilitated.

It should be understood that, although the spring tongue 34 of the retention clip 30 is described as an integral part of the spring arm 32 in this embodiment, the spring tongue 34 may also be stamped from the bridge 33, in which case the bridge 33 is made of a metal material.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A retention clip for retaining a card in a central slot of a card edge connector, comprising a pair of opposite spring arms and a bridge connecting the spring arms, each spring arm including a vertical first end portion for engaging with an insulative housing of the card edge connector, and a horizontal second end portion extending through the bridge and forming an inclined spring tongue at the free end thereof, the inclined spring tongue downwardly projecting beyond a lower surface of the bridge for resiliently retaining the card in the central slot of the card edge connector in a vertical direction, the bridge having retaining means for engaging with a top edge portion of the card for retaining the card in the central slot of the card edge connector in a lateral direction relative to the insulative housing of the card edge connector.

2. The retention clip as described in claim 1, wherein the vertical first end portion of each spring arm comprises a retention section for detachably engaging with each opposite longitudinal end of the insulative housing of the card edge connector.

3. The retention clip as described in claim 2, wherein the retention section of the spring arm includes a pair of longitudinally extending wings for engaging with opposite longitudinal ends of the insulative housing of the card edge connector, and a pair of laterally and outwardly extending flanges at respective free ends of the wings for engaging with the insulative housing of the card edge connector.

4. The retention clip as described in claim 1, wherein the retaining means of the bridge comprises a pair of large-dimensioned end sections downwardly projecting from the lower surface thereof, each large-dimensioned end section defining a groove therein for receiving the top edge portion of the card.

5. A retention clip for retaining a card in a central slot of a card edge connector, comprising a pair of substantially vertical spring arms and a horizontal bridge connecting the spring arms, each spring arm having a first end portion for engaging with an insulative housing of the card edge connector, and a second end portion connected with the bridge, the bridge having retaining means for engaging with a top edge portion of the card for retaining the card in the central slot of the card edge connector in a lateral direction relative to the insulative housing of the card edge connector, the retention clip further comprising a pair of inclined spring tongues downwardly projecting beyond a lower surface of the bridge for retaining the card in the central slot of the card edge connector in a vertical direction.

6. The retention clip as described in claim 5, wherein the first end portion of each spring arm comprises a retention section for detachably engaging with each opposite longitudinal end of the insulative housing of the card edge connector.

7. The retention clip as described in claim 6, wherein the retention section of the spring arm includes a pair of longitudinally extending wings for engaging with opposite longitudinal ends of the insulative housing of the card edge connector, and a pair of laterally and outwardly extending flanges at respective free ends of the wings for engaging with the insulative housing of the card edge connector.

8. The retention clip as described in claim 5, wherein the retaining means of the bridge comprises a pair of large-dimensioned end sections downwardly projecting from the lower surface thereof, each large-dimensioned end section defining a groove therein for receiving the top edge portion of the card.

9. The retention clip as described in claim 5, wherein the second end portion of the spring arm extends through the bridge, and the spring tongue is formed by downwardly bending the free end of the second end portion.

10. The retention clip as described in claim 5, wherein the spring tongue is downwardly stamped from the bridge.

11. A card edge connector assembly comprising:

a card edge connector comprising an insulative housing defining an elongated central slot therein and a plurality of terminals received in the insulative housing;

a card inserted into the central slot of the insulative housing of the card edge connector; and a retention clip assembled to the insulative housing of the card edge connector for retaining the card in the central slot of the card edge connector, the retention clip including a pair of substantially vertical spring arms sandwiching opposite side edges of the card, and a horizontal bridge connecting the spring arms, the bridge engaging with a top edge portion of the card to retain the card in the central slot in both vertical and lateral directions;

wherein a second free end of the spring arm extends through the bridge, a spring tongue is formed by downwardly bending the second free end of the spring arm and downwardly presses against the top edge portion of the card.

12. The card edge connector assembly as described in claim 11, wherein the insulative housing of the card edge connector forms a pair of engaging sections on respective longitudinal ends thereof, and wherein each spring arm of the retention clip comprises a retention section at a first free end thereof for detachably engaging with a corresponding engaging section of the insulative housing of the card edge connector.

13. The card edge connector assembly as described in claim 12, wherein the engaging section of the insulative housing of the card edge connector includes an upper ledge, a peg downwardly extending from the ledge and a recess defined at the junction between the peg and the body of the insulative housing, and wherein the retention section of the spring arm includes a pair of longitudinally extending wings for engaging with a corresponding peg of the insulative housing of the card edge connector, and a pair of laterally and outwardly extending flanges at respective free ends of the wings for engaging with corresponding recesses of the insulative housing of the card edge connector.

14. The card edge connector assembly as described in claim 11, wherein the bridge forms a pair of large-dimensioned end sections downwardly projecting from the lower surface thereof, each large-dimensioned end section defining a groove therein for receiving the top edge portion of the card.

15. The card edge connector assembly as described in claim 11, wherein the spring tongue is downwardly stamped from the bridge.

16. The card edge connector assembly as described in claim 11, wherein each of said pair of spring arms extends about a full height of said card with an end section engaged with a longitudinal end of the housing.

* * * * *